US009161412B2

(12) United States Patent
Lou et al.

(10) Patent No.: US 9,161,412 B2
(45) Date of Patent: Oct. 13, 2015

(54) LED DRIVING AND DIMMING CIRCUIT AND CONFIGURATION METHOD

(71) Applicant: ZHEJIANG SHENGHUI LIGHTING CO., LTD, Jiaxing (CN)

(72) Inventors: Junshan Lou, Jiaxing (CN); Jinxiang Shen, Jiaxing (CN)

(73) Assignee: ZHEJIANG SHENGHU LIGHTING CO., LTD., Jiaxing (CN)

( * ) Notice: Subject to any disclaimer, the term of this patent is extended or adjusted under 35 U.S.C. 154(b) by 0 days.

(21) Appl. No.: 14/421,051

(22) PCT Filed: Sep. 3, 2014

(86) PCT No.: PCT/CN2014/085872

§ 371 (c)(1),
(2) Date: Feb. 11, 2015

(87) PCT Pub. No.: WO2015/039561

PCT Pub. Date: Mar. 26, 2015

(65) Prior Publication Data

US 2015/0230307 A1 Aug. 13, 2015

(30) Foreign Application Priority Data

Sep. 18, 2013 (CN) ..... 2013 1 0429592

(51) Int. Cl.

| | |
|---|---|
| ***H05B 41/16*** | (2006.01) |
| ***H05B 41/24*** | (2006.01) |
| ***H05B 33/08*** | (2006.01) |
| ***H05B 37/02*** | (2006.01) |

(52) U.S. Cl.
CPC ..... *H05B 33/0845* (2013.01); *H05B 37/02* (2013.01)

(58) Field of Classification Search
None
See application file for complete search history.

(56) References Cited

U.S. PATENT DOCUMENTS

| | | | | |
|---|---|---|---|---|
| 8,358,090 | B1 | 1/2013 | Mednik et al. | |
| 2009/0322255 | A1 * | 12/2009 | Lin | 315/307 |
| 2011/0109249 | A1 * | 5/2011 | Liu et al. | 315/307 |
| 2013/0200814 | A1 * | 8/2013 | Chen et al. | 315/210 |

FOREIGN PATENT DOCUMENTS

| | | | |
|---|---|---|---|
| CN | 101621878 | A | 1/2010 |
| CN | 202587536 | U | 12/2012 |
| CN | 103533705 | A | 1/2014 |
| CN | 203554729 | U | 4/2014 |

* cited by examiner

*Primary Examiner* — Anh Tran
(74) *Attorney, Agent, or Firm* — Anova Law Group, PLLC

(57) ABSTRACT

An LED driving and dimming circuit and configuration method are provided. The circuit can include a switch connected to an AC power supply, an LED driver circuit connected to the switch, a switch-status detection circuit connected to the switch, and a brightness-selection circuit having one end connected to the switch-status detection circuit and another end connected to the LED driver circuit. The switch-status detection circuit is configured to detect whether the switch is open or closed and to output a detected result to the brightness-selection circuit. The LED driver circuit is configured to control a brightness level of the LED lighting device, according to a voltage result from the brightness-selection circuit.

18 Claims, 2 Drawing Sheets

LED DRIVING AND DIMMING CIRCUIT AND CONFIGURATION METHOD

CROSS-REFERENCES TO RELATED APPLICATIONS

This PCT application claims priority to Chinese Patent Application No. 201310429592.4, filed on Sep. 18, 2013, the entire content of which is incorporated herein by reference.

FIELD OF THE DISCLOSURE

The present disclosure generally relates to the field of LED (i.e., light emitting diode) lighting technology and, more particularly, relates to a driving and dimming circuit for an LED lighting device and a method for configuring the driving and dimming circuit.

BACKGROUND

LED lighting may generally provide advantages in energy conservation, environmental protection, controllable lighting, solid state lighting, and long operational lifetime. LED lamps thus have been widely used in various areas for public, commercial, and/or indoor lighting.

Often, LED lamps may have lamp-head structures generally-designed similar to incandescent lamps, energy saving lamps, and other conventional lamps. Presumably, LED lamps may be used to directly replace other conventional lamps by an easy installation without changing original structures of a lighting system including other conventional lamps.

However, when other conventional lamps are replaced by conventional LED lamps, dimming feature of the LED lamps may not be applied, because those other conventional lamps do not include any dimmers to implement the dimming feature of the replaced LED lamps. To add a dimmer in those conventional systems can increase cost in use and can require complicated, additional installation.

In some LED lamps, a switch may be used to replace a dimmer to control brightness of an LED lamp. One method of using a switch for dimming control includes a stepless dimming process. When a user presses the switch for a first time, lighting brightness of the lamp may gradually change from a minimum brightness level to a maximum brightness level, which may take a few seconds. During this gradual changing process, if the user presses the switch for a second time, the lamp may be turned off and the brightness level at this point may be memorized by the LED lamp. When the user presses the switch for a third time, the lamp may provide the previously-memorized brightness. When the user presses the switch for a fourth time, the lamp may then be turned off. When the switch is pressed again, the process may be repeated. In some cases, after pressing the switch for the first time, the user may not press the switch during the time interval for gradually changing brightness from the minimum level to the maximum level. The lamp may then be operated at the maximum brightness level until the switch is pressed again to turn off the lamp.

In another method of using a switch for dimming control, a brightness level may be selected from several set-brightness levels. In a two-level dimming process, the lamp may be operated at a first set-brightness level when the switch is pressed for a first time. When the switch is pressed for a second time, the lamp may be turned off. When the switch is pressed for a third time, the lamp may be operated at a second set-brightness level. When the switch is pressed for a fourth time, the lamp may be turned off. When the switch is pressed for a fifth time, the lamp may be operated at the first set-brightness level, which is the same as for the step when the switch is pressed for the first time. Such a process may then be repeated.

In other cases, the brightness level may be selected using a dimming chip or a microcontroller (MCU). Such designs, however, require complicated circuit and increase the cost for the LED lamps.

BRIEF SUMMARY OF THE DISCLOSURE

One aspect or embodiment of the present disclosure includes a driving and dimming circuit for driving an LED lighting device. The circuit can include a switch connected to an AC power supply, an LED driver circuit connected to the switch, a switch-status detection circuit connected to the switch, and a brightness-selection circuit having one end connected to the switch-status detection circuit and another end connected to the LED driver circuit. The switch-status detection circuit is configured to detect whether the switch is open or closed and to output a detected result to the brightness-selection circuit. The LED driver circuit is configured to control a brightness level of the LED lighting device, according to a voltage result from the brightness-selection circuit.

The switch-status detection circuit includes a first comparator, a second comparator, and a first capacitor. The first comparator has an output end connected to an input end of the second comparator. The first capacitor has one end connected to the output end of the first comparator and has another end grounded.

The brightness-selection circuit includes a self-latching circuit and a second capacitor configured in parallel with the self-latching circuit. The self-latching circuit includes a first transistor, a second transistor, a first resistor, a second resistor, a third resistor, and a fourth resistor. Optionally, the first transistor is a PNP type transistor, and the second transistor is an NPN type transistor. The first transistor, the third resistor, and the fourth resistor are connected in series. The second transistor, the first resistor, and the second resistor are configured in series.

The first transistor has a collector connected to the third resistor, and has an emitter and a base respectively connected to both ends of the first resistor. The second transistor has a collector connected to the second resistor, and has an emitter and a base respectively connected to both ends of the fourth resistor.

Alternatively, the switch-status detection circuit includes a first comparator, a second comparator, a capacitor, and a resistor. The brightness-selection circuit includes a T'-counter. The first comparator has an output end connected to a CP (clock pulse) terminal of the T'-counter. The second comparator has an output end connected to a reset terminal of the T'-counter. The capacitor has one end connected to supply power to the first and second comparators. The capacitor has another end be grounded and also connected to a non-inverting input end of the second comparator via the resistor.

Another aspect or embodiment of the present disclosure includes a method for configuring a driving and dimming circuit for driving an LED lighting device. A switch is connected to an AC power supply in the driving and dimming circuit. Each of an LED driver circuit and a switch-status detection circuit is connected to the switch. A brightness-selection circuit is configured to have one end connected to the switch-status detection circuit and another end connected to the LED driver circuit. The switch-status detection circuit detects whether the switch is open or closed and outputs a detected result to the brightness-selection circuit. The LED driver circuit controls a brightness level of the LED lighting device, according to a voltage result of the brightness-selection circuit.

The switch-status detection circuit includes a first comparator, a second comparator, and a first capacitor. The first comparator has an output end connected to an input end of the second comparator. The first capacitor has one end connected to the output end of the first comparator and has another end grounded.

The brightness-selection circuit includes a self-latching circuit and a second capacitor configured in parallel with the self-latching circuit. The self-latching circuit includes a first transistor, a third resistor, and a fourth resistor connected in series. The self-latching circuit also includes a second transistor, a first resistor, and a second resistor configured in series. The first transistor has a collector connected to the third resistor, and has an emitter and a base respectively connected to both ends of the first resistor. The second transistor has a collector connected to the second resistor, and has an emitter and a base respectively connected to both ends of the fourth resistor.

The circuit is configured such that: when the switch is pressed for a first time to close the circuit, the self-latching circuit does not operate, and the brightness-selection circuit outputs a voltage to the LED driver circuit to operate the LED lighting device at a first set-brightness level. When the switch is pressed for a second time to open the circuit, the second comparator outputs a high level voltage to trigger the self-latching circuit and to output a low level voltage to the LED driver circuit.

When the switch is pressed for a third time to close the circuit within a time period of $T_L$, counted from a time when the switch is pressed for the second time to a time that the second capacitor is depleted to reset the self-latching circuit, the LED driver circuit receives a voltage to operate the LED lighting device at a second set-brightness level.

When the switch is pressed for a third time to close the circuit after a time period of $T_L$, counted from a time when the switch is pressed for the second time to a time that the second capacitor is depleted to reset the self-latching circuit, the LED driver circuit receives a voltage to operate the LED lighting device back at the first set-brightness level.

Alternatively, the switch-status detection circuit includes a first comparator, a second comparator, a capacitor, and a resistor. The brightness-selection circuit includes a T'-counter. The first comparator has an output end connected to a CP (clock pulse) terminal of the T'-counter. The second comparator has an output end connected to a reset terminal of the T'-counter. The capacitor has one end connected to supply power to the first and second comparators. The capacitor has another end be grounded and also connected to a non-inverting input end of the second comparator via the resistor.

The circuit is configured such that: when the switch is pressed for a first time to close the circuit, the LED driver circuit operates the LED lighting device at a first set-brightness level. After the switch is pressed for a second time to open the circuit and when the switch is pressed for a third time to close the circuit within a time period of $T_L$, counted from a time when the switch is pressed for the second time to a time that the first capacitor is depleted, the LED driver circuit receives a high level voltage to operate the LED lighting device at a second set-brightness level.

Alternatively, after the switch is pressed for the second time to open the circuit, and when the switch is pressed for the third time to close the circuit after the time period of $T_L$, counted from a time when the switch is pressed for the second time to a time that the first capacitor is depleted, the LED driver circuit receives a low voltage to operate the LED lighting device back at the first set-brightness level.

Other aspects or embodiments of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

Reference will now be made in detail to exemplary embodiments of the disclosure, which are illustrated in the accompanying drawings. Wherever possible, the same reference numbers will be used throughout the drawings to refer to the same or like parts.

An LED driving and dimming circuit and configuration method are provided. An exemplary driving and dimming circuit for driving an LED lighting device can include, for example, an AC power supply, a switch connected to the AC power supply, an LED driver circuit connected to the switch, a switch-status detection circuit connected to the switch, and/or a brightness-selection circuit having one end connected to the switch-status detection circuit and having another end connected to the LED driver circuit.

The switch-status detection circuit can be configured to detect whether the switch is closed or opened and to output a detected result to the brightness-selection circuit. The brightness-selection circuit can have an output end connected to the LED driver circuit. The LED driver circuit can be configured to control a brightness level of the LED lighting device, according to a voltage result from the brightness-selection circuit.

In one embodiment, the switch-status detection circuit can include a first comparator, a second comparator, and/or a first capacitor. The first comparator can have an output end connected to an input end of the second comparator. The first capacitor can have one end connected to the output end of the second comparator and can have another end be grounded.

The brightness-selection circuit can include a self-latching circuit and a second capacitor configured in parallel with the self-latching circuit. The self-latching circuit can include a first transistor, a second transistor, a first resistor, a second resistor, a third resistor, and a fourth resistor.

In another embodiment, the switch-status detection circuit can include a first comparator and a second comparator. In this case, the brightness-selection circuit may include a T'-counter. The first comparator can have an output end connected to a CP (clock pulse) terminal of the T'-counter, and the second comparator can have an output end connected to a reset terminal of the T'-counter.

As such, a switch-status detection circuit and a brightness-selection circuit can be included in the disclosed LED driving and dimming circuit. Further, the switch-status detection circuit and a brightness-selection circuit can be included into the LED lighting device. Each of the switch-status detection circuit and the brightness-selection circuit can be formed by discrete components. Compared with a conventional LED driver circuit, the added switch-status detection circuit and brightness-selection circuit can provide desired function with a low cost while adding little extra changes to conventional circuit lines. Embodiments consistent with the present disclosure thus may decrease the cost of the LED lighting devices.

Figure 1:
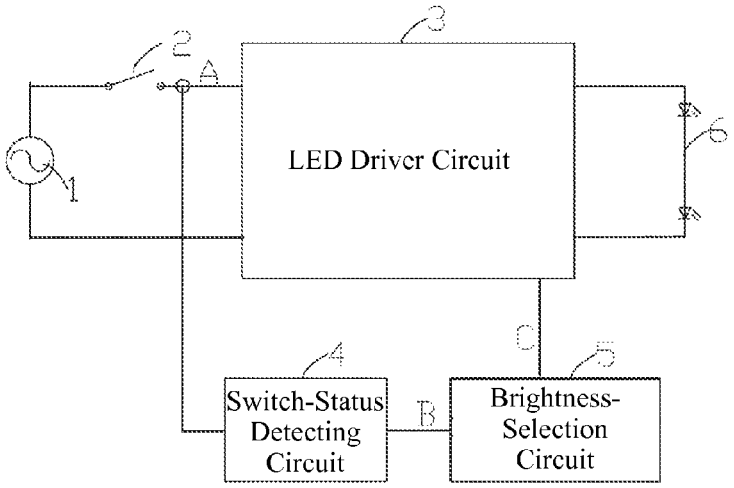
FIG. 1 depicts an exemplary LED driving and dimming circuit consistent with various disclosed embodiments.

FIG. 1 depicts an exemplary LED driving and dimming circuit consistent with various disclosed embodiments. As shown in FIG. 1, the LED driving and dimming circuit can be used to drive an LED lighting device 6.

The LED driving and dimming circuit can include an AC power supply 1, a switch 2, an LED driver circuit 3, a switch-status detection circuit 4, and/or a brightness-selection circuit 5. Among them, each of the AC power supply 1, the switch 2, and the LED driver circuit 3 can include any suitable control structure(s) for LED lighting devices as desired.

As disclosed herein, the switch-status detection circuit 4 can be configured to detect whether the switch 2 is turned on or turned off, and to output detected result to the brightness-selection circuit 5. The brightness-selection circuit 5 can have an output end connected to the LED driver circuit 3. According to a voltage result from the brightness-selection circuit 5, the LED driver circuit 3 can thus control brightness level of the LED lighting device 6.

Figure 2:
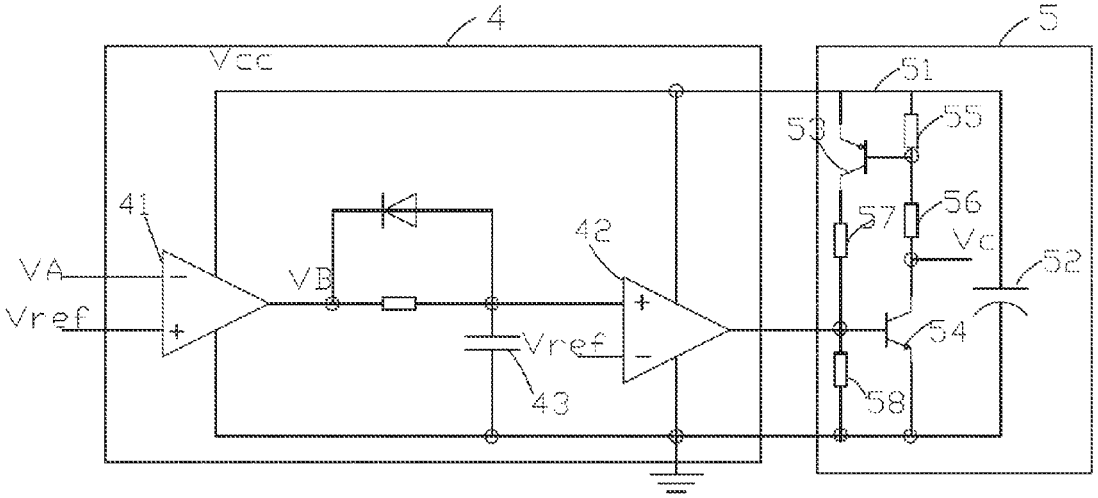
FIG. 2 depicts an exemplary circuit block including a switch-status detection circuit and a brightness-selection circuit in an LED driving and dimming circuit consistent with various disclosed embodiments.

FIG. 2 depicts an exemplary circuit block including a switch-status detection circuit and a brightness-selection circuit configured in an LED driving and dimming circuit consistent with various disclosed embodiments. As shown in FIG. 2, the switch-status detection circuit 4 can include a first comparator 41, a second comparator 42, and/or a first capacitor 43.

The first comparator 41 can have an output end connected to an input end of the second comparator 42. The first capacitor 43 can have one end connected to the output end of the first comparator 41 and can have another end be grounded.

The brightness-selection circuit 5 can include a self-latching circuit 51 and a second capacitor 52, configured in parallel with the self-latching circuit 51. The self-latching circuit 51 can include a first transistor 53 and a second transistor 54, e.g., configured in series. The self-latching circuit 51 can further include a first resistor 55, a second resistor 56, a third resistor 57, and/or a fourth resistor 58.

In one embodiment, the first transistor 53 can be a PNP type transistor, while the second transistor 54 can be an NPN type transistor. The first transistor 53, the third resistor 57, and/or the fourth resistor 58 can be connected in series. The second transistor 54, the second resistor 56, and/or the first resistor 55 can also be configured in series. The first transistor 53 can have a collector connected to the third resistor 57. The first transistor 53 can also have an emitter and a base respectively connected to both ends of the first resistor 55. The second transistor 54 can have a collector connected to the second resistor 56. The second transistor 54 can also have an emitter and a base respectively connected to both ends of the fourth resistor 58.

In operation, when the switch 2 is pressed for a first time, the switch 2 can close the circuit. Voltage $V_A$ at point A as shown in FIG. 1 can be at a high level and can be greater than a reference voltage $V_{ref}$ of the first comparator 41 as shown in FIG. 2. The first comparator 41 can output a low level voltage $V_B$, while the second comparator 42 can also output a low level voltage. Voltage $V_C$ at point C shown in FIGS. 1-2 can be at a high level. When the LED driver circuit 3 receives a voltage $V_C$, the LED lighting device 6 can be operated at a first set-brightness level.

When the switch 2 is pressed for a second time, the switch 2 can open the circuit. Voltage $V_A$ at point A can be reduced. When the voltage $V_A$ is lower than the reference voltage $V_{ref}$ of the first comparator 41, the first comparator 41 can output voltage $V_B$ at a high level. After a time delay $T_d$, the first capacitor 43 can be charged to have a potential $V_{cl}$ higher than reference voltage $V_{ref}$ of the second comparator 42. The second comparator 42 can output a high level voltage to trigger the self-latching circuit 51 and to change voltage $V_C$ from the high level to a low level. The self-latching circuit 51 can be powered by the second capacitor 52 as shown in FIG. 2. After a period of time $T_L$, the second capacitor 52 can be depleted, and the self-latching circuit 51 can be restored (or reset). The period of time $T_L$ can be counted from the time when the switch 2 is pressed for the second time to the time when the second capacitor 52 is fully depleted.

In one embodiment, when the switch 2 is pressed for a third time to close the circuit before the time period of $T_L$ when the second capacitor 52 is depleted, the LED driver circuit 3 can receive the low level voltage $V_C$, and the LED lighting device 6 can be operated at a second set-brightness level.

In another embodiment when the switch 2 is pressed for the third time to close the circuit after the time period of $T_L$, as the self-latching circuit 51 is restored, the voltage $V_C$ can be at a high level and the LED driver circuit 3 can operate the LED lighting device 6 at the first set-brightness level. In various embodiments, the first set-brightness level may require a low voltage $V_C$, while the second set-brightness level may require a high voltage $V_C$; or vice versa, depending on specific applications.

Likewise, when the switch 2 is pressed for a fourth time to open the circuit (e.g., as similar to when the switch 2 is pressed for the second time) and for a fifth time to close the circuit (e.g., as similar to when the switch 2 is pressed for the third time) with a time interval less than the time period of $T_L$, the LED driver circuit 3 can operate the LED lighting device 6 at the second set-brightness level. In another case, when the switch 2 is pressed for a fourth time and fifth time with a time interval greater than the time period of $T_L$, the LED driver circuit 3 can operate the LED lighting device 6 at the first set-brightness level.

Such a dimming control process of the LED lighting device between the first and second set-brightness levels can be repeated. In various embodiments, $T_d$ and $T_L$ for charging and/or depleting a corresponding capacitor can be configured according to specific applications.

Note that although two levels of set-brightness are primarily described in the present disclosure, the disclosed driving and dimming circuit can be used to control dimming of the LED lighting device for more than two levels of set-brightness. For example, the time period $T_L$ counted from a time for pressing the switch for the second time to the time for the second capacitor 52 to be depleted can be controlled sufficiently long, such that, during the time period of $T_L$, the switch 2 can pressed not only for the third time, but also for an additional fourth time, an additional fifth time, an additional sixth time, etc. Accordingly, the LED driver circuit 3 can receive the voltage $V_C$ at various levels to control the LED lighting device 6 to be operated at the second set-brightness level and also at a third set-brightness level, a fourth set-brightness level, a fifth set-brightness level, etc.

Figure 3:
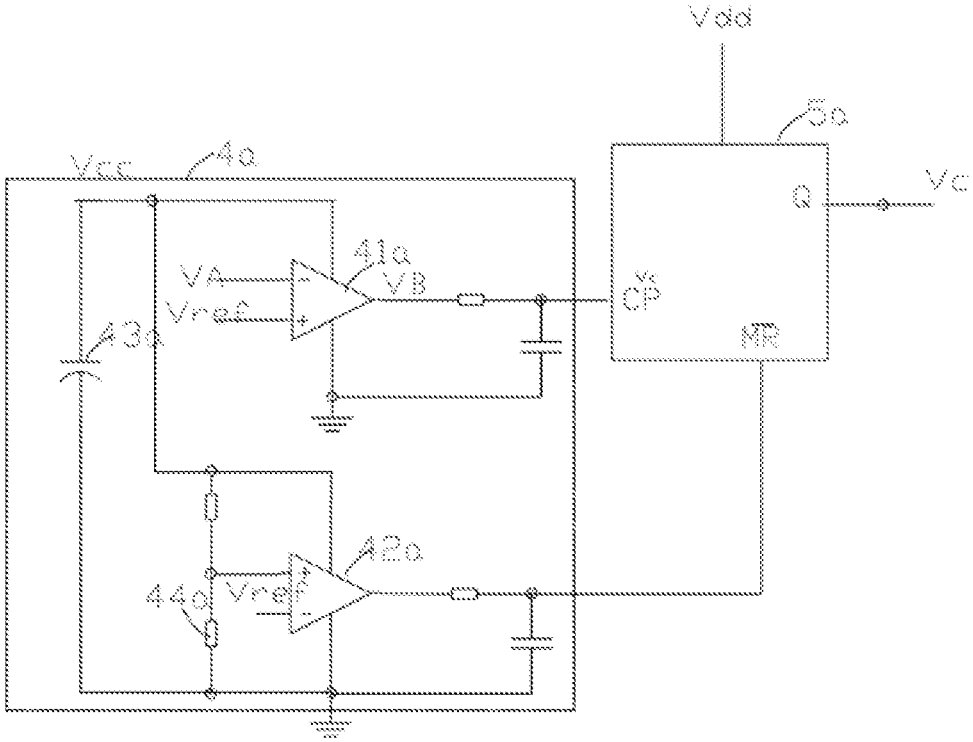
FIG. 3 depicts another exemplary circuit block including a switch-status detection circuit and a brightness-selection circuit in an LED driving and dimming circuit consistent with various disclosed embodiments.

FIG. 3 depicts another exemplary circuit block including a switch-status detection circuit and a brightness-selection circuit in an LED driving and dimming circuit consistent with various disclosed embodiments.

As shown, the switch-status detection circuit 4*a* in FIG. 3 can include a first comparator 41*a*, a second comparator 42*a*, a first capacitor 43*a*, and/or a fifth resistor 44*a*. The first capacitor 43*a* can have one end connected to supply power to the first and second comparators 41*a* and 42*a*. The first capacitor 43*a* can have other end be grounded and also be connected to a non-inverting input end of the second comparator 42*a* via the fifth resistor 44*a*.

The brightness-selection circuit 5*a* can include a T'-counter. The output end of the first comparator 41*a* can be connected to a CP (clock pulse) terminal of the T'-counter. The output end of the second comparator 42*a* can be connected to a reset terminal of the T'-counter, as shown in FIG. 3.

In operation, when the switch 2 is pressed for a first time, the switch 2 can close the circuit. The first capacitor 43*a* can be charged. When voltage $V_{r5}$ of the fifth resistor 44*a* is lower than the reference voltage $V_{ref}$ of the second comparator 42*a*, the second comparator 42*a* can output a low level voltage. The T'-counter can be reset. Thereafter, when voltage $V_{r5}$ of the fifth resistor 44*a* is increased to be higher than the reference voltage $V_{ref}$ of the second comparator 42*a*, the second comparator 42*a* can output a high level voltage. When voltage $V_A$ at point A as shown in FIGS. 1 and 3 is greater than $V_{ref}$ of the first comparator 41*a*, the first comparator 41*a* can output a voltage $V_B$ at a low level, while the second comparator 42*a* can still output the high level voltage. In this case, the T'-counter does not operate and maintains at an initial state, and voltage $V_C$ is outputted at a low level by the brightness-selection circuit 5*a* to the LED driver circuit 3. When the LED driver circuit 3 receives the low level voltage $V_C$, the lighting device 6 can be operated at a first set-brightness level.

When the switch 2 is pressed for a second time, the switch 2 can open the circuit. Voltage $V_A$ at point A can be reduced. When the voltage $V_A$ is lower than the reference voltage $V_{ref}$ of the first comparator 41*a*, the first comparator 41*a* can output a voltage $V_B$ that becomes a high level. After a time delay $T_d$ for the T'-counter to flip, voltage $V_C$ can change from the low level to a high level. After the switch 2 is pressed for the second time, the voltage of the first capacitor 43*a* is reduced. After a time length $T_L$, voltage $V_{r5}$ of the fifth resistor 44*a* is less than $V_{ref}$ of the second comparator 42*a*, voltage outputted by the second comparator 42*a* can change from the high level to a low level. T'-counter can then be reset.

In an embodiment when the switch 2 is pressed for a third time during the time period of $T_L$, the LED driver circuit 3 can receive the high level voltage $V_C$ and the LED lighting device can operate at a second set-brightness level.

However, in the case when the switch 2 is pressed for the third time following the time period of $T_L$, as the T'-counter is reset and voltage $V_C$ is at a low level, the LED driver circuit 3 can operate the LED lighting device 6 at the first set-brightness level.

Likewise, when the switch 2 is pressed for a fourth time (which is similar to the case when the switch 2 is pressed for the second time), the first comparator 41*a* can output a voltage at a high level. The T'-counter can flip. Voltage $V_C$ can change from one level to another level. In one embodiment, when a time interval between the fourth time and a fifth time of pressing the switch 2 falls within the time period of $T_L$, the LED driver circuit 3 can operate the LED lighting device 6 back at the first set-brightness level. As such, the LED driver circuit 3 can operate the LED lighting device 6 between the two set-brightness levels.

In this manner, such a dimming control process of the LED lighting device between the first and second set-brightness levels can be repeated. In various embodiments, $T_d$ and $T_L$ for corresponding counter and capacitor can be configured according to specific applications.

Note that although two levels of set-brightness are primarily described in the present disclosure, the disclosed driving and dimming circuit can be used to control dimming of the LED lighting device for more than two levels of set-brightness. For example, the time period $T_L$ counted from a time for pressing the switch for the second time to the time for the first capacitor 43*a* to be depleted can be controlled sufficiently long, such that, during the time period of $T_L$, the switch 2 can pressed not only for the third time, but also for an additional fourth time, an additional fifth time, an additional sixth time, etc. Accordingly, the LED driver circuit 3 can receive the voltage $V_C$ at various levels to control the LED lighting device 6 to be operated at the second set-brightness level and also at a third set-brightness level, a fourth set-brightness level, a fifth set-brightness level, etc.

In addition, the disclosed driving and dimming circuit and the LED lighting device can be used to directly replace other lighting sources (e.g., incandescent lamps and/or halogen lamps) without changing their layout of lighting systems. For example, the driving and dimming circuit can be installed within a lamp-head structure of the LED lighting device. Such a lamp-head structure can be easily transported and installed with the LED lighting device to replace other lighting sources in any lighting system.

Note that, the term "comprising", "including" or any other variants thereof are intended to cover a non-exclusive inclusion, such that the process, method, article, or apparatus containing a number of elements also include not only those elements, but also other elements that are not expressly listed; or further include inherent elements of the process, method, article or apparatus. Without further restrictions, the statement "includes a" does not exclude other elements included in the process, method, article, or apparatus having those elements.

The embodiments disclosed herein are exemplary only. Other applications, advantages, alternations, modifications, or equivalents to the disclosed embodiments are obvious to those skilled in the art and are intended to be encompassed within the scope of the present disclosure.

INDUSTRIAL APPLICABILITY AND ADVANTAGEOUS EFFECTS

Without limiting the scope of any claim and/or the specification, examples of industrial applicability and certain advantageous effects of the disclosed embodiments are listed for illustrative purposes. Various alternations, modifications, or equivalents to the technical solutions of the disclosed embodiments can be obvious to those skilled in the art and can be included in this disclosure.

An LED driving and dimming circuit and configuration method are provided. The circuit can include a switch connected to an AC power supply, an LED driver circuit connected to the switch, a switch-status detection circuit connected to the switch, and a brightness-selection circuit having one end connected to the switch-status detection circuit and another end connected to the LED driver circuit. The switch-status detection circuit is configured to detect whether the switch is open or closed and to output a detected result to the brightness-selection circuit. The LED driver circuit is configured to control a brightness level of the LED lighting device, according to a voltage result from the brightness-selection circuit.

As such, a switch-status detection circuit and a brightness-selection circuit can be included in the disclosed LED driver circuit. Each of the switch-status detection circuit and the brightness-selection circuit can be formed by discrete components. Compared with a conventional LED driver circuit, the added switch-status detection circuit and brightness-selection circuit can provide desired function at a low cost without much additional changes over conventional circuit lines. Embodiments consistent with the present disclosure thus may decrease the cost of the LED lighting devices.

In addition, the disclosed driving and dimming circuit and the LED lighting device can be used to directly replace other lighting sources (e.g., incandescent lamps and/or halogen lamps) without changing their layout of lighting systems. For example, the driving and dimming circuit can be installed within a head structure of the LED lighting device. Such head structures can be easily transported to replace other lighting sources in any lighting system.

REFERENCE SIGN LIST

AC power supply 1
Switch 2
LED driver circuit 3
Switch-status detection circuit 4
Brightness-selection circuit 5
LED lighting device 6
First comparator 41
Second comparator 42
First capacitor 43
Self-latching circuit 51
Second capacitor 52
First transistor 53
Second transistor 54
First resistor 55
Second resistor 56
Third resistor 57
Fourth resistor 58
Switch-status detection circuit 4*a*
Brightness-selection circuit 5*a*
First comparator 41*a*
Second comparator 42*a*
First capacitor 43*a*
Fifth resistor 44*a*

What is claimed is:

1. A driving and dimming circuit for driving an LED lighting device, comprising:

a switch connected to an AC power supply;

an LED driver circuit connected to the switch;

a switch-status detection circuit connected to the switch; and a brightness-selection circuit having one end connected to the switch-status detection circuit and another end connected to the LED driver circuit, wherein:

the switch-status detection circuit is configured to detect whether the switch is open or closed and to output a detected result to the brightness-selection circuit, the switch-status detection circuit comprises a first comparator, a second comparator, and a first capacitor, wherein the first comparator has an output end connected to an input end of the second comparator, and the first capacitor has one end connected to the output end of the first comparator and has another end grounded, and the LED driver circuit is configured to control a brightness level of the LED lighting device, according to a voltage result from the brightness-selection circuit.

2. The circuit according to claim 1, wherein the brightness-selection circuit comprises a self-latching circuit and a second capacitor configured in parallel with the self-latching circuit.

3. The circuit according to claim 2, wherein the self-latching circuit comprises a first transistor, a second transistor, a first resistor, a second resistor, a third resistor, and a fourth resistor.

4. The circuit according to claim 3, wherein the first transistor is a PNP type transistor, and the second transistor is an NPN type transistor.

5. The circuit according to claim 3, wherein the first transistor, the third resistor, and the fourth resistor are connected in series, and wherein the second transistor, the first resistor, and the second resistor are configured in series.

6. The circuit according to claim 3, wherein the first transistor has a collector connected to the third resistor, and has an emitter and a base respectively connected to both ends of the first resistor.

7. The circuit according to claim 3, wherein the second transistor has a collector connected to the second resistor, and has an emitter and a base respectively connected to both ends of the fourth resistor.

8. The circuit according to claim 1, wherein the switch-status detection circuit comprises a first comparator, a second comparator, a capacitor, and a resistor.

9. The circuit according to claim 8, wherein the brightness-selection circuit comprises a T'-counter, wherein the first comparator has an output end connected to a CP (clock pulse) terminal of the T'-counter, and the second comparator has an output end connected to a reset terminal of the T'-counter.

10. The circuit according to claim 8, wherein the capacitor has one end connected to supply power to the first and second comparators, and the capacitor has another end be grounded and also connected to a non-inverting input end of the second comparator via the resistor.

11. A method for configuring a driving and dimming circuit for driving an LED lighting device, comprising:

configuring a switch connected to an AC power supply in the driving and dimming circuit;

connecting an LED driver circuit to the switch;

connecting a switch-status detection circuit to the switch; and configuring a brightness-selection circuit having one end connected to the switch-status detection circuit and another end connected to the LED driver circuit, wherein the switch-status detection circuit detects whether the switch is open or closed and outputs a detected result to the brightness-selection circuit, wherein the switch-status detection circuit comprises a first comparator, a second comparator, and a first capacitor, wherein the first comparator has an output end connected to an input end of the second comparator, and the first capacitor has one end connected to the output end of the first comparator and has another end grounded, and wherein the LED driver circuit controls a brightness level of the LED lighting device, according to a voltage result of the brightness-selection circuit.

12. The method according to claim 11, wherein the brightness-selection circuit comprises a self-latching circuit and a second capacitor configured in parallel with the self-latching circuit.

13. The method according to claim 12, wherein the self-latching circuit comprises a first transistor, a third resistor, and a fourth resistor connected in series, and comprises a second transistor, a first resistor, and a second resistor configured in series; wherein the first transistor has a collector connected to the third resistor, and has an emitter and a base respectively connected to both ends of the first resistor; and wherein the second transistor has a collector connected to the second resistor, and has an emitter and a base respectively connected to both ends of the fourth resistor.

14. The method according to claim 13, wherein the circuit is configured such that:

when the switch is pressed for a first time to close the circuit, the self-latching circuit does not operate, and the brightness-selection circuit outputs a voltage to the LED driver circuit to operate the LED lighting device at a first set-brightness level; and when the switch is pressed for a second time to open the circuit, the second comparator outputs a high level voltage to trigger the self-latching circuit and to output a low level voltage to the LED driver circuit.

15. The method according to claim 14, wherein the circuit is configured such that:

when the switch is pressed for a third time to close the circuit within a time period of $T_L$, counted from a time when the switch is pressed for the second time to a time that the second capacitor is depleted to reset the self-latching circuit, the LED driver circuit receives a voltage to operate the LED lighting device at a second set-brightness level.

16. The method according to claim 14, wherein the circuit is configured such that:

when the switch is pressed for a third time to close the circuit after a time period of $T_L$, counted from a time when the switch is pressed for the second time to a time that the second capacitor is depleted to reset the self-latching circuit, the LED driver circuit receives a voltage to operate the LED lighting device back at the first set-brightness level.

17. The method according to claim 11, wherein the switch-status detection circuit comprises a first comparator, a second comparator, a capacitor, and a resistor, and the brightness-selection circuit comprises a T'-counter; wherein the first comparator has an output end connected to a CP (clock pulse) terminal of the T'-counter, and the second comparator has an output end connected to a reset terminal of the T'-counter; and wherein the capacitor has one end connected to supply power to the first and second comparators, and the capacitor has another end be grounded and also connected to a non-inverting input end of the second comparator via the resistor.

18. The method according to claim 17, wherein the circuit is configured such that:

when the switch is pressed for a first time to close the circuit, the LED driver circuit operates the LED lighting device at a first set-brightness level; and after the switch is pressed for a second time to open the circuit and when the switch is pressed for a third time to close the circuit within a time period of $T_L$, counted from a time when the switch is pressed for the second time to a time that the first capacitor is depleted, the LED driver circuit receives a voltage to operate the LED lighting device at a second set-brightness level; or after the switch is pressed for the second time to open the circuit, and when the switch is pressed for the third time to close the circuit after the time period of $T_L$, counted from a time when the switch is pressed for the second time to a time that the first capacitor is depleted, the LED driver circuit receives a voltage to operate the LED lighting device back at the first set-brightness level.

* * * * *